United States Patent [19]

Prüm et al.

[11] Patent Number: 5,000,433

[45] Date of Patent: Mar. 19, 1991

[54] FOLDER

[75] Inventors: Sebastian A. Prüm, Kaiserslautern; Trifon Panow, Weinheim; Emil Fischer, Oggersheim, all of Fed. Rep. of Germany

[73] Assignee: Albert-Frankenthal AG, Frankenthal, Fed. Rep. of Germany

[21] Appl. No.: 387,518

[22] Filed: Jul. 28, 1989

[30] Foreign Application Priority Data

Aug. 20, 1988 [DE] Fed. Rep. of Germany ..... 3828372

[51] Int. Cl.[5] ..... B42C 1/00

[52] U.S. Cl. ..... 270/49; 270/21.1; 270/47

[58] Field of Search ..... 270/21.1, 47, 48, 49, 270/50, 51, 60

[56] References Cited

U.S. PATENT DOCUMENTS

| | | | |
|---|---|---|---|
| 2,131,363 | 9/1938 | Barber | 270/47 |
| 4,094,499 | 6/1978 | Thomas | 270/60 |
| 4,190,242 | 2/1980 | Bolza-Schunemann | 270/50 |
| 4,295,644 | 10/1981 | van der Meulen | 270/60 |

FOREIGN PATENT DOCUMENTS

| | | | |
|---|---|---|---|
| 1810294 | 10/1969 | Fed. Rep. of Germany | 270/47 |

*Primary Examiner*—Edward K. Look
*Assistant Examiner*—Therese M. Newholm
*Attorney, Agent, or Firm*—Edwin D. Schindler

[57] ABSTRACT

A folder, and more particularly an adjustable folder for web feed gravure presses, comprising a collect cylinder able to be set for collect runs and non-collect runs and provided with holding elements (preferably in the form of grippers) and tucking blades having actuating elements preferably in the form of follower rollers which are operated by a respective cam, whose active cam part, which is preferably in the form of a recess, is adapted to be selectively exposed and covered over by means of a covering means, which is coaxial to the cam and is provided with drive cam elements which are mounted on cam element carriers coaxial to the cam and are able to be driven. In order to achieve a high degree of adaptability as regards different types of collect operations the covering cam elements of the covering device are mounted on the cam element carrier in such a manner that they may be radially adjusted.

20 Claims, 5 Drawing Sheets

5
4
14
15
20
22
11
36
35
37
24
19
16
17
12
9
10
2
24
18
33
34
3
1
21
32
40
39
49
13
50
17
16
51
52
15
14
53
6
7
8
57
43
41
42
38
45
54
46
48
47
44
56
55

FOLDER

BACKGROUND OF THE INVENTION.

The invention relates to a folder, and more particularly to an adjustable folder for web feed gravure presses, comprising a collect cylinder able to be set for collect runs and non-collect runs and provided with holding elements (preferably in the form of grippers) and tucking blades having actuating elements preferably in the form of follower rollers which are operated by a respective cam, whose active cam part, which is preferably in the form of a recess, is adapted to be selectively exposed and covered over by means of a covering means, which is coaxial to the cam and is provided with drive cam elements which are mounted on cam element carriers coaxial to the cam and are able to be driven.

In an experimental set-up tested by the applicant the covering means comprised a driven cover disk with fixed covering cam elements. In such an arrangement it is necessary for the cover disk to be operated not only during collect runs but also non-collect runs, which in practice are more frequent. This tends to lead to substantial loading of the mechanism and thus to heavy wear. Apart from this in such an arrangement the number of sequential collect operations is limited two sequential collect operations as experience has shown. Three and more collect operations are practically not possible. On the other hand however there is a tendency to increase the press breadth and thus the gravure cylinder diameter as well. Furthermore the most frequently encountered paper sizes are becoming shorter and shorter so that there are more etchings on the periphery than formerly, as for example eight in number, this leading to a a need for an increase in the collect operations.

SUMMARY OF THE INVENTION.

Taking these earlier designs as a starting point, one object of the present invention is accordingly that of improving upon a folder of the initially mentioned type with simple and low-price means so that the number of consecutive collect operations and thus the number of possible types of production may be increased.

In principle the invention is able to attain this object in a surprisingly simple way since the covering cam elements of the covering device are mounted on the cam element carrier in such a manner that they may be radially adjusted.

These features lead in practice to an adjustable covering disk and thus to more than two collect operations. The folder is thus of more general application than has been possible in the prior art, with whose aid all products produced on one rotation of a gravure cylinder having up to eight etchings may be readily collected on each other, this involving a rational production of comparatively thick products as well. A still further advantage of the features of the invention is that the adjustable covering disk may readily be kept immobile during non-collect runs, all or at least the potentially interfering covering cam elements simply being retracted out of the way. Such retraction is advantageous as regards the avoidance of unnecessary wear.

In accordance with an advantageous further development of the invention the covering cam elements may be arranged to be adjusted by means of an adjusting disk which is coaxial to the cam element carrier and is able to be driven with the carrier and adjusted in relation to it in the peripheral direction. These features make possible a simple adjustment of the covering cam elements by turning the adjustment disk so that there is the possibility of automatic presetting. It is convenient if the cam element carrier and the associated, regularly driven adjustment disk are drivingly connected together by means of a differential drive, which is able to be adjusted by means of an auxiliary drive device, which is able to be put out of operation during the course of production. After setting, the differential drive functions practically as an inherently rigid transmission member.

In accordance with a further advantageous feature of the invention the cam element carriers and, respectively, adjustment disks associated with the tucking blades and the holding elements are connected with each other in a rotation transmitting manner and are preferably releasably clamped onto each other. These features make possible a common drive of the two cam element carriers or, respectively, of the two adjustment disks, something that leads to a great simplification in structure and at the same time to a high accuracy. The cams associated with the tucking blades and, respectively, the holding elements are in thus respect advantageously offset with such an axial spacing that the two associated covering devices may be placed therebetween.

As further feature of the invention it is possible for the holding element drive cam to be adjusted in the peripheral direction by an auxiliary drive device, which is preferably able to be put out of operation even during the course of production. This makes possible an adaptation to the respective production in such a manner that short page sizes may be released earlier on that longer ones.

A further advantageous feature of the invention for simplifying the loading cam element arrangement and of the adjustment disks may be one which is so designed that during collect runs the covering device may be driven at different speeds in accordance with the number of the desired collect operations.

A further feature of the invention is one in which the drive device associated with the covering devices has an intermediate shaft parallel to the cylinder axis, such intermediate shaft making it possible for the cam element carriers to be driven directly and for the adjustment disks to be driven through the intermediacy of the adjustable differential drive; the intermediate shaft is for its part able to be coupled by means of a coupling part slidingly arranged on it, as to be in register, with the one respective wheel of a number of drive wheels (which have different diameters) placed opposite to each other and mounted in a freely rotatably manner thereon, such drive wheels meshing with a double wheel able to be driven by a cylinder part. The result of this design is the advantage of operating settings with two different drive speeds and immobility in the center setting of the coupling part. This thus provides the simple possibility of disenabling the covering devices during non-collect runs while during collect runs they are driven in a way dependent on the number of desired collect operations.

In the case of a double-breadth folder with tucking blades and holding means divided up over the breadth of the folder and operating devices arranged adjacent to the two ends of a cylinder, with associated covering devices it is possible for the latter to be driven simply by means of a common intermediate shaft arranged radially outside the collect cylinder and extending continuously along the length of the cylinder so that it is only at one cylinder end that a coupling device of the above described type is required, something that again leads to a simplification of design.

Further advantageous developments of the invention will now be described with reference to the drawings showing only one preferred embodiment.

LIST OF THE SEVERAL VIEWS OF THE FIGURES.

DETAILED DESCRIPTION OF PREFERRED EMBODIMENT OF THE INVENTION.

Figure 1:
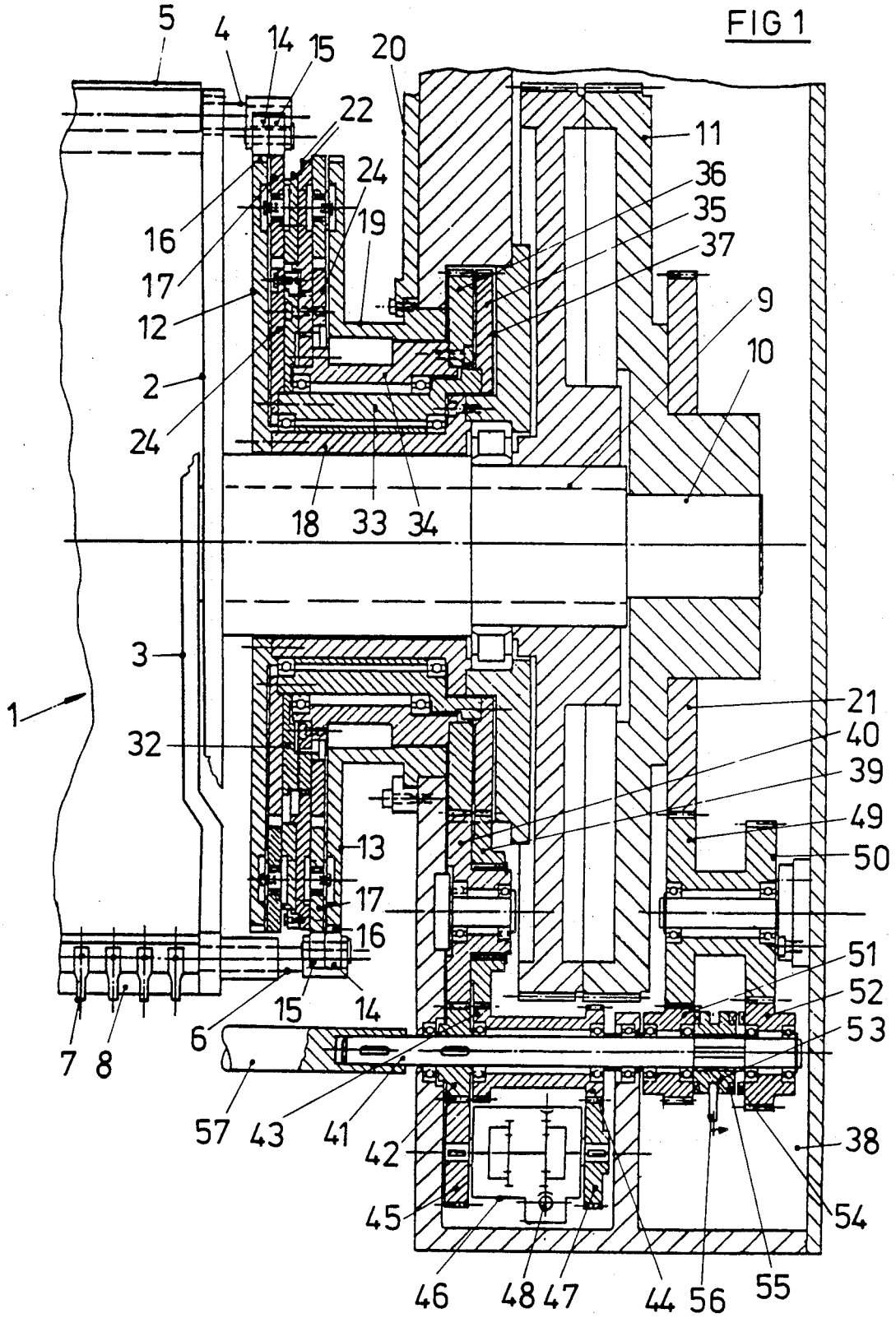
FIG. 1 is a longitudinal section taken through the drive and control device of a collect cylinder of a folder in accordance with the present invention.

The collect cylinder 1 shown in FIG. 1 of a variable or adjustable folder, as is generally placed at the delivery end of web feed gravure press, consists of two fixture carriers which in cross section are stellate and are able to be evenly driven, same having the form of a laterally bearinged tucking blade part 2 and of a gripper part 3 bearinged thereon. The tucking blade part 2 is provided with a tucking blades 5 able to be operated by an actuating device 4. The gripper part 3 is provided with gripper bars 8 bearing grippers 7 and able to be operated by an actuating device 6. Drive wheels 11 with the same diameter are keyed side by side on the coaxial journals 9 and 10 of the tucking blade part 3 and, respectively, of the gripper part 3. These drive wheels may be coupled together by means of a bridging drive, not shown here, to ensure even drive while at the same time allowing a possibility of adjustment.

In order to perform a folding operation the tucking blades 5 are moved outwards and the grippers 7 are opened. For this purpose there are cams 12 and, respectively, 13 placed coaxially to the cylinder at the end of the same, which actuate follower means for operation of the associated actuating devices 4 and, respectively, 6. The actuating devices 4 and, respectively, 6 for this purpose each comprise two follower rollers 14 and 15 mounted on a common shaft alongside each other and of which the one follower roller 14 runs on the respectively associated drive cam 12 and, respectively, 13 and the other follower roller 15 runs on a respective covering device, adjacent to one of the cams 12 and, respectively, 13, for laterally covering over the cam recess 16 on the cam side, such recess 16 causing operation of the tucking blades 5 and, respectively, the grippers 7. Clear of the cam recess 16 the cams 12 and, respectively, 13 have a circular peripheral form. Dependent on the type of production run the cam recesses 16 are freed during each rotation of the collect cylinder 1 (non-collect run) or during each n-th rotation of the collect cylinder 1 (collect run) and are otherwise laterally covered over. The covering devices are for this purpose provided with covering cam elements 17 arranged in parallelism with the respectively associated cam 12 and, respectively, 13. The breadth of the follower rollers 14 and, respectively, 15 is the same as the breadth of the cams 12 and 13 and, respectively, the covering cam elements 17.

The cams 12 and 13 are stationary in relation to the driven collect cylinder 1. The cam 12 provided for operation of the tucking blades 5 is secured to a bushing 18 fixed to the housing and encompassing the outer journal 9. The cam 13 associated with the grippers 7 is secured to a radially outer bushing 19 rotatably mounted in the machine frame. An adjustment bar 20 is secured to the bushing 19 and is used for adjustment of the cam 13 for timing the opening of the grippers. The adjustment bar 20 may be driven by means of an auxiliary drive in the form of an auxiliary motor or the like for adjusting the paper size or it may be simply be adjusted by hand. During production the adjustment bar is locked so that it cannot be twisted. The covering devices having the covering cam elements 17 and associated with the cams 12 and, 13 respectively, are driven during production so as to move in relation to the cams 12 and 13 which are stationary. For this purpose the outer drive wheel 11 has a drive gear ring 21 flanged on it, from which the drive of the two covering devices associated with the two cams 12 and, respectively, 13 is derived.

Figure 2:
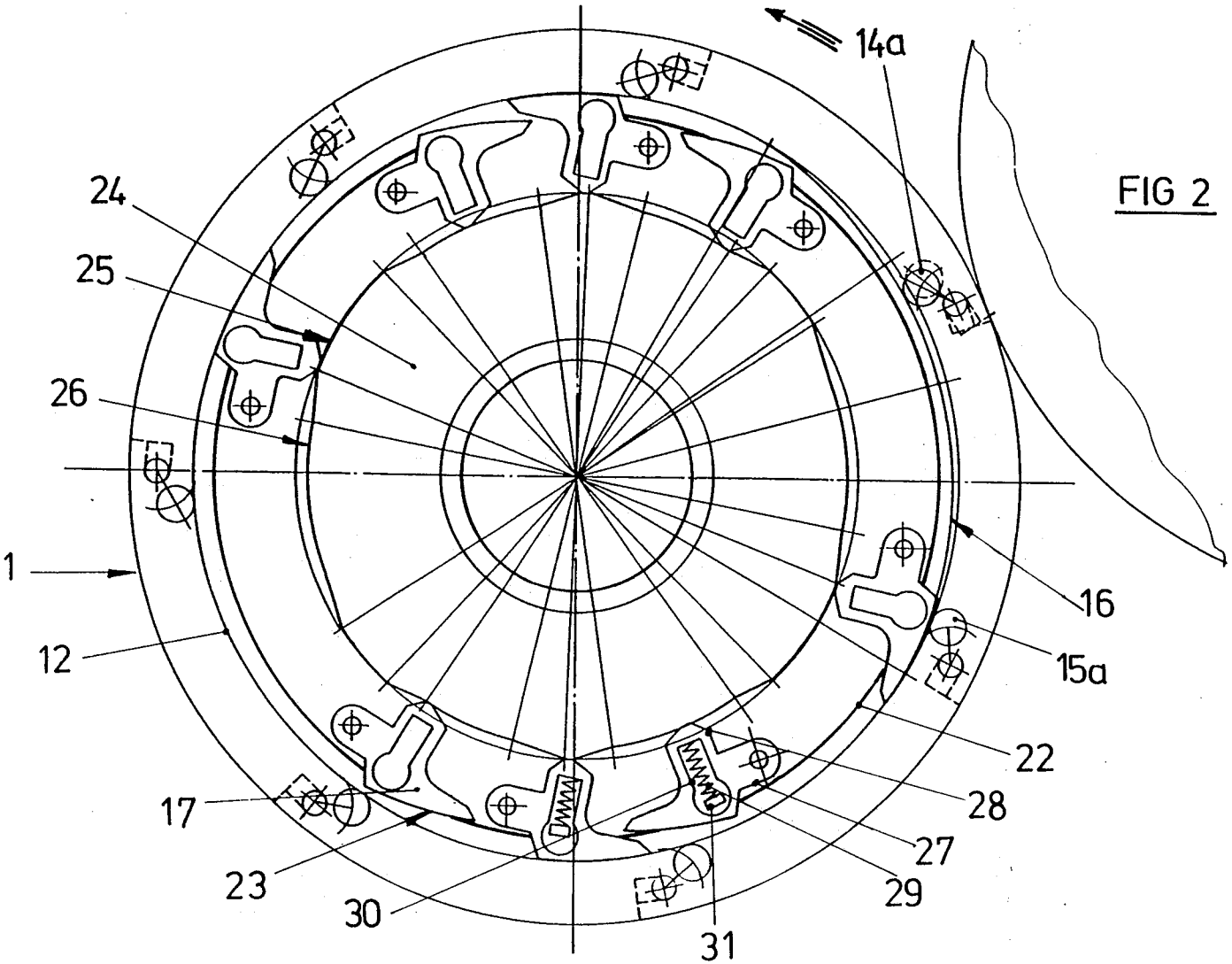
FIG. 2 to FIG. 5 show views of an adjustable covering disk, provided in accordance with the invention with retractable covering cam elements and having different cam element settings for different production runs.

As may be diagrammatically seen from FIG. 2 for the covering devices for the cam 12 associated with the tucking blades, the two covering devices each comprise a cam element carrier 22, arranged coaxially to the respective cam and on which the covering cam elements 17 are mounted with a possibility of adjustment in a radial direction. The peripheral form 23 of the covering cam elements 16 represents a part of a circle with a radius conforming to the radius of the circular cam 12 provided outside the cam recess 16 formed by a peripheral recess. The peripheral form 23 of the covering cam elements 17 may be changed between a radially outer active setting aligned with the circular arc contour of the associated cam 12 and a passive position within the cam recess by setting the covering cam elements 17. In the active setting, the covering cam elements 17 cover over the recess 16 laterally on moving past it so that the follower roller running on the respective cam 12 or, respectively, 13 is prevented by a covering cam element 17 from falling into the cam recess 16 and causing a folding operation when it moves over the cam recess 16. This is indicated at 15*a*. The actuating device associated with the tucking blade 5 (FIG. 2) just passing through the folding or tucking gap may on the other hand drop into the cam recess 16 and lead to a folding operation, as is in fact indicated at 14*a*. In order to adjust the covering cam elements 17 there is setting or adjustment disk 24, respectively, arranged coaxially in relation to the cam element carrier 22 and aligned axially with the covering cam element 17. The disk 24 is provided with fixed cam elements 25 and peripheral recesses 26 arranged therebetween.

The covering cam elements 17 are respectively attached to a pivoting arm 27 able to pivot about an axis parallel to the axis and mounted on the cam element carrier 22 and have a radially inwardly extending follower 28 which is held by the action of a loading spring 29 in contact with the peripheral surface of the associated setting disk 24. The loading spring 29 is received in a recess 30 of the associated covering cam element 17 and at one end bears on the inner end of the recess 30 on the cam element side and at the other end on a pin 31 which extends into the recess 30 and is attached to the cam element carrier 22.

After adjustment of the disk 24, the cam element carriers 22 bearing the adjustment disk 24 and the covering cam elements 17 are evenly driven during operation so that the during the operation of the folder the covering cam elements maintain their position as determined by the adjustment disk. The drive speed of the entire covering device formed by the cam element carriers and the adjustment disk is however selected in a manner dependent on the respective type of production that the covering cam elements 17 which have been outwardly set move clear of the cam recess 16 in such a manner that only the desired number of folding operations is performed.

Since the tucking blades 5 and the grippers 7 associated therewith operate synchronously, the two cam element carriers 22 and the two setting disks 24 of the respectively associated coving devices may be permanently connected with each other to simplify the necessary drive means. Accordingly, as will be further seen from FIG. 1, the two cams 12 and, respectively, 13 are so spaced apart axially that the covering devices, which are arranged with the mutually abutting cam element carriers 22, have sufficient space therebetween. The cam element carriers 22 placed back to back are firmly clamped together by clamping means. The adjustment disks 24 placed under the covering cam elements 17 turned towards the respectively associated cam 12 and, respectively, 13, are screwed together with a spacing member 32 between them with a thickness conforming to the overall thickness of the cam element carriers which are clamped together. In order to rotatably support the cam element carriers 22 joined together and, respectively, the covering disks 24 there are two bushings 33 and 34 arranged in the part between the bushings 18*a* and 19 bearing the cams 12 and 13. The radially inner bushing 33 carries the directly abutting cam element carriers 22 and the radially outer bushing 34 carries the adjustment disks 24 connected together with the spacing member 32 between them. A respective one of the adjustment disks 24 and one of the cam element carriers 22 is arranged so that its radially inner edge extends in this respect as far as the respectively associated bushing 33 and, respectively, 34 and is screwed to the same. The respectively other setting disk 24 and the respectively other cam element carrier 22 may come to an end further to the outside. The spacing member 32 has its spacing jaws extending through the window associated with same, of the cam element carrier 22 secured to the bushing 34. The other cam element carrier 22 comprises the spacing member 32.

The bushings 33 and 34 bearing the setting disks 24 and, respectively, the cam element carriers 22 are rotatably supported and at their ends remote form the cylinder are provided with flange mounted drive gear rings 35 and 36 with the same diameter, which are received in a chamber 37 (delimited by the bushings 18 and 29 on the cam side and which is accessible from the gear box 38). The driving gear rings 35 and 36 are in mesh with associated intermediate wheels 39 and 40 of the same diameter, which are rotatably mounted on the frame. The intermediate wheel 40 in the gear train associated with the cam element carriers 22 in this respect meshes with a pinion 42 keyed on an intermediate shaft arranged parallel to the cylinder axis outside the diameter of the collect cylinder. The intermediate wheel 39 belonging to the gear train of the adjustment disks 24 is in mesh with a gear ring 43 of a double wheel, whose two gear rings 43 and 44 have the same diameter as the pinion 42. The pinion is in mesh with the input wheel 45 of a differential drive 46 arranged parallel to the axis and adjacent to the intermediate shaft 41, whose output wheel 47 is in mesh with the second gear ring 44 of the double wheel bearinged on the intermediate shaft 41. The differential drive 46 makes possible an adjustment of the output wheel 47 in relation to the input wheel 45 having the same diameter by means of an auxiliary drive device 48. During normal production the auxiliary drive device 48 is inactivated so that the differential drive 46 functions as a rigid double wheel. Prior to the start of production the adjustment disks 24 may be rotationally set as desired by operation of the auxiliary drive device 48.

The intermediate shaft 41 bearinged in the gear box 38 is for its part able to be driven at different speeds by means of the drive gear ring 21 flanged on the outer drive wheel 11. For this purpose there is a double wheel, bearinged on the intermediate shaft 41 (which is secured to the frame) and having two gear rings 49 and 50 with different diameters, which for their part are in mesh with drive wheels 51 and 52 able to turn freely on the intermediate shaft 41. The drive wheels 51 and 52 are able to be alternatively coupled with the intermediate shaft 41 by means of a coupling dog 35 arranged between them and able to slide on the intermediate shaft 41. The drive wheels 51 and 52 are for this purpose provided with two axially projecting dog teeth 54 on their facing ends and the coupling part 53 having suitable recesses 55 is able to be engaged with these teeth 54 so that there is a defined coupling effect with the desired register. By means of an operating lever 56 fitting into a peripheral groove the coupling part 53 is able to be moved out of the left engagement position shown in FIG. 1 through a center position in which there is no engagement, into a right engagement position. By suitable operation of the operating lever 56 it is thus possible to bring about two different speeds of operation and, respectively, a stationary state of the covering devices.

In the illustrated working example of the invention with a 7-part collect cylinder the cam element carrier 22 is, as will furthermore be seen from FIG. 2, provided with eight adjustable covering cam elements 17, whose peripheral form 23 subtends an angle of approximately 15°. The eight covering cam elements 17 are distributed in two groups offset by 180°, each of four covering cam elements 17 with an angle of 90° between them, as seen in the clockwise direction the first and second peripheral cam elements being offset by 30°, the second and third peripheral cam elements being offset by 15° and the third and fourth peripheral cam elements being offset by 45°. The setting disk 24 is in this respect provided with six fixed peripheral cam elements 25, which are distributed in two groups offset by 180°, with three peripheral cam elements in each group. As seen in the clockwise direction, that is to say the direction of rotation, the first and the second peripheral cam elements 25 are offset by 48.25° and the second and third peripheral cam elements are offset by 57.25° in relation to each other. The peripheral cam elements 25 of the setting disk 24 have a different peripheral extent unlike the covering cam elements 17. The first peripheral cam element 25 in this case subtends an angle of 13.5° and the second peripheral cam element 25 subtends an angle of 1°. The third peripheral cam element 25 subtends an angle of 24.5°. In connection with a 7-part collect cylinder this distribution of the cam elements 17 and of the peripheral cam elements 25 and, respectively, of the peripheral recesses 26 of the setting disk 24 together with the different drive speeds make possible any desired type of production from non-collect to double-collect and threefold-collect.

The setting of the adjustment disk 24 shown in FIG. 2 and the setting of the covering cam elements 17 is in accordance with the double-collect type of production so that the product is a three-ply one. This type of production frequently occurs in the case of the use of a gravure cylinder with six etchings on the periphery. In this respect the setting disk 24 is so placed that respectively each second covering cam element 17, in the present case the second and fourth covering cam elements of each group, are put out of operation. The drive speed, that is to say the speed of rotation of the cam element carrier 22 and of the setting disks 24 is in this case equal to 6/7 of the speed of the cylinder. The result of this is that the seven tucking blades on the periphery of the tucking blade part 2 only encounters a free cam recess 16 on every third rotation of the collect cylinder 1 and only then perform a folding operation as is indicated in FIG. 2. The same naturally applies for the grippers 7.

Figure 3:
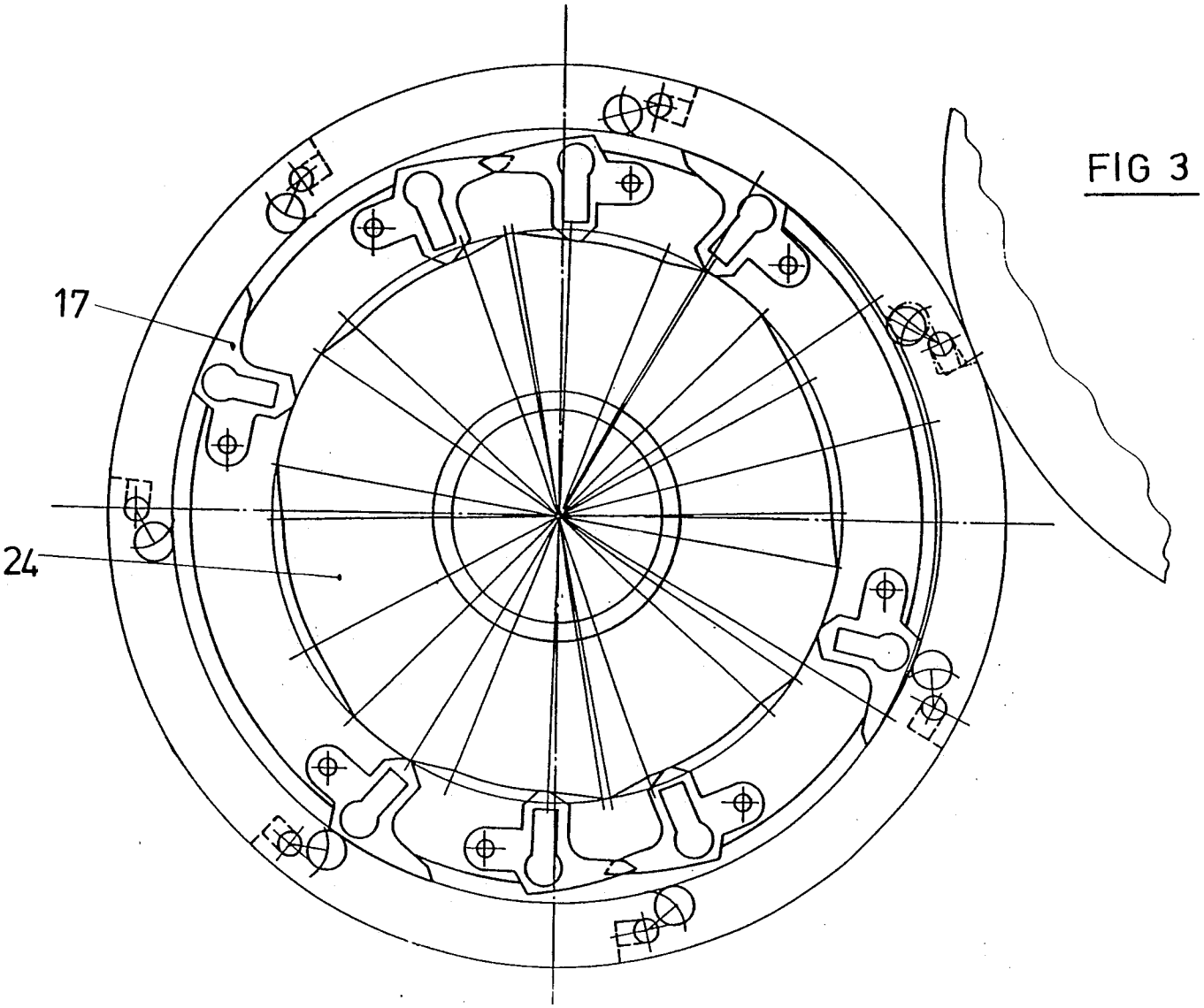

In the case of the single-collect as a type of production which leads to two plies, and may occur in the case of the use of a gravure cylinder with four or eight etchings on the periphery, as may be seen from FIG. 3 the setting disk 24 is so set that in each case the two inner covering cam elements 17 of each group are retracted and the two outer covering cam elements 17 of each group are moved out. The four outwardly set covering cam elements 17 are accordingly offset by respectively 90° in relation to each other. In the case of this type of production the drive speed amounts of $\frac{7}{8}$ of the cylinder speed.

Figure 4:
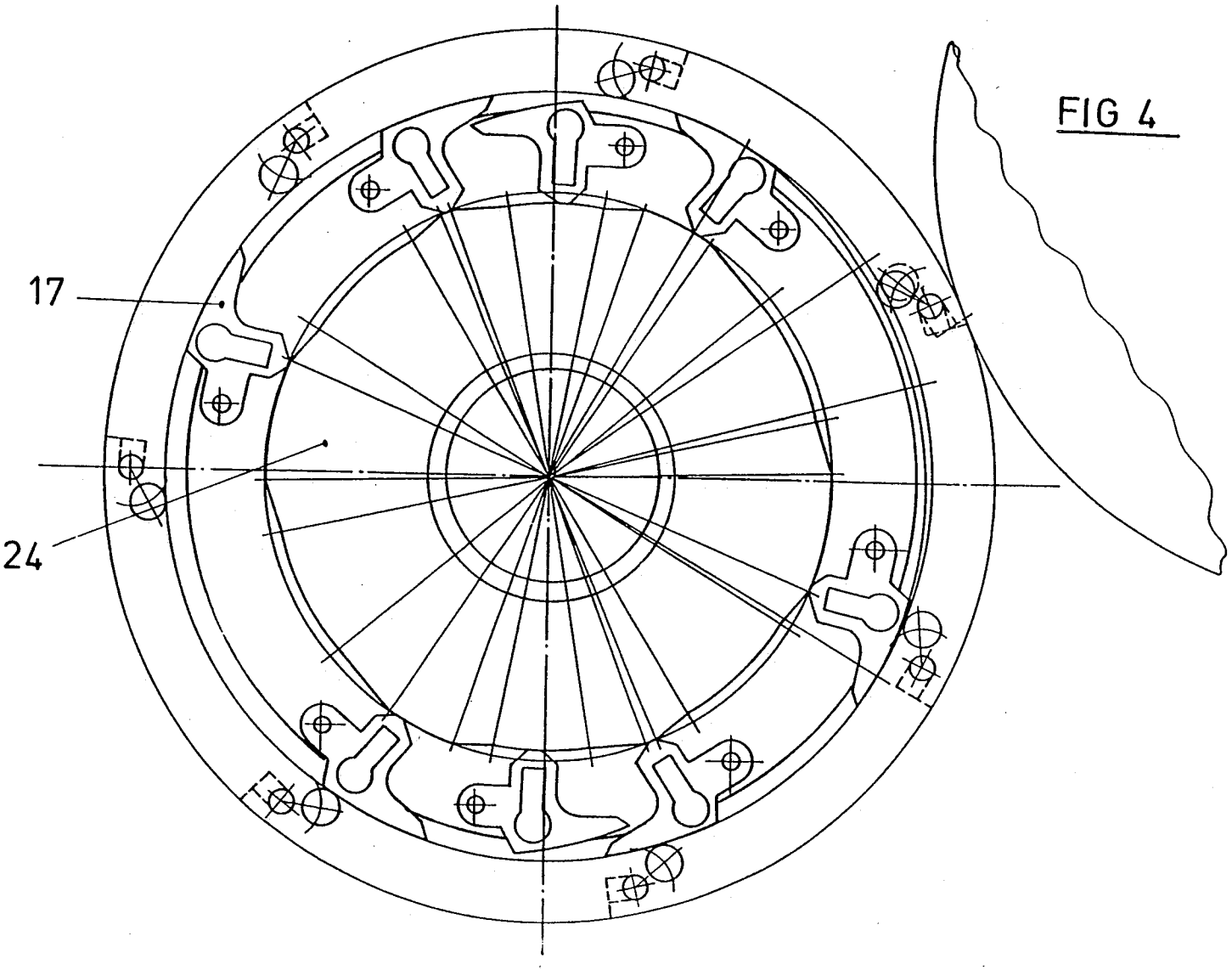

For the threefold-collect type of production as leads to a four ply product and may occur in the case of the use of gravure cylinder with eight etchings on the periphery, the setting disk 24 is so set as may be seen form FIG. 4, that all covering cam elements of each group are moved outwards. In this type of production the speed of the drive also amounts to $\frac{7}{8}$ of the cylinder speed. On changing over to single-collect and, respectively, threefold-collect to double-collect it is accordingly necessary for the coupling part 53 to be reset from the one engagement position to the other one.

Figure 5:
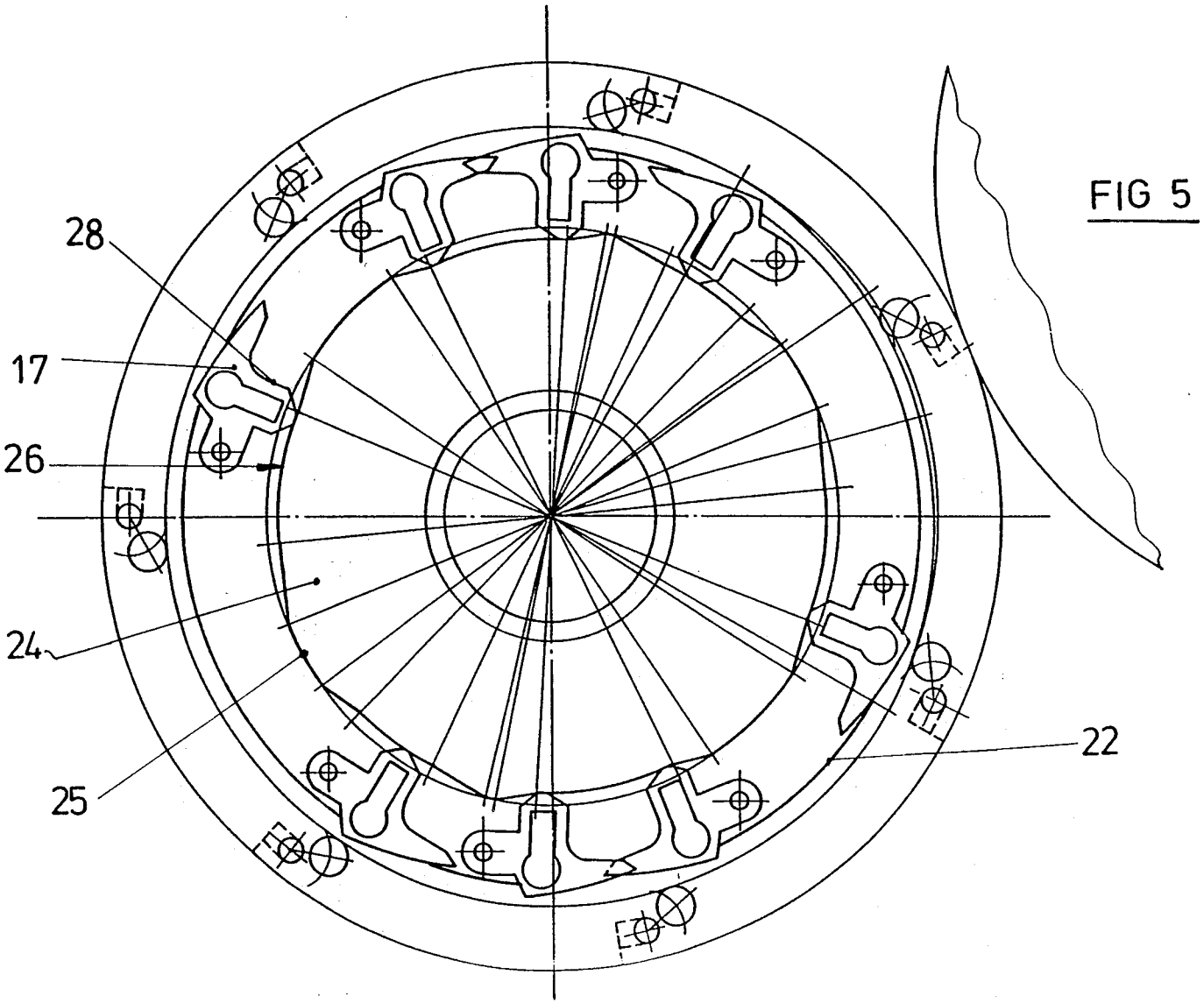

In the case of the type of production without any collect, in which a single-ply product is produced, the tucking blades are put into operation during each rotation of the collect-cylinder 1. The same applies for the grippers 7. In this case, as may be seen from FIG. 5, all the covering cam elements 17 are retracted so that the setting disk 24 is moved into a position in which the followers 28 of all the covering cam elements 17 are located adjacent to a peripheral recess 26 of the setting disk 24 and the peripheral cam elements thereof 25 are positions between two respective followers 28. The setting disk 24 and the cam element carriers 22 may in the case of this type of production be driven at any desired speed or they may be inactivated in order to reduce wear, for which purpose the coupling part 53 is simply moved into a center setting in which it does not make engagement.

The structure and the workings of the covering device associated with the gripper actuation are the same as the covering device for the tucking blade actuation system of FIGS. 2 through 5 but with the difference that the grippers holding the start of the sheet have already moved through the folding gap when the folding operation is performed. The activation of the tucking blades 5 and the opening of the grippers 7 thus takes place essentially simultaneously. These operations do however last a certain time and the opening of the grippers 7 takes place somewhat earlier the processing of short products than is the case with the processing of longer ones, this being effected by the rotatability, as described above, of the gripper cam 13 by means of the setting shaft 20.

In the context of a so-called double width folder, on which two products placed side by side may be processed, the gripper rails 8 and the tucking blades 5 are subdivided along the length of the cylinder, each side of the cylinder having its own operating means. The structure of these two operating devices may be the same as the structure indicated in FIG. 1 for the operating device for the right hand cylinder half, but with the difference that the intermediate shaft 41 is not able to be coupled with the cylinder drive by means of an associated dog clutch, and it is connected via a bridging shaft 57 with the opposite intermediate shaft 41, as will also be seen from FIG. 1. The result is thus a common drive shaft extending over the full length of the cylinder.

In the above described working example of the invention the setting of the covering cam elements is performed by associated setting disks 24, something that makes possible an automatic presetting by suitable programming of the auxiliary drive device 48. However it would also be possible for the covering cams elements 17 to be individually set by hand in accordance with suitable instructions. In this case the cam element carrier 22 would simply be provided with suitable holding devices to hold the covering cam elements 17.

We claim:

1. A folder for web feed gravure presses, comprising a collect cylinder able to be set for collect runs and non-collect runs and provided with holding elements in the form of grippers, and tucking blades having actuating elements in the form of follower rollers which are operated by a respective cam, an active cam part, which is in the form of a recess, is adapted to be selectively exposed and covered over by means of a covering means, which is coaxial to the cam and is provided with drive cam elements which are mounted on cam element carriers coaxial to the cam and are able to be driven, covering cam elements of each covering device being able to be adjusted radially and being received in respectively associated cam element carriers with said covering cam elements being adjustable by means of a setting disk which is coaxial to the cam element carrier and which is adapted to be driven with the cam element carrier and is adjustable in relation thereto in a peripheral direction.

2. The folder as claimed in claim 1 wherein the covering cam elements are secured to a pivoting arm pivoted on the cam element carrier and are provided with a follower adapted to be pressed, by means of a spring, on the adjustment disk provided with fixed peripheral cam elements are arranged adjacent to the cam element carrier.

3. The folder as claimed in claim 2, wherein the spring is received in a recess in the associated covering cam element and bears on a pin extending into the recess and attached to the cam element carrier.

4. The folder as claimed in claim 1 wherein the covering cam elements have a periphery in the form of a section of a circle which is able to be moved outwards as far as a radius corresponding to the radius of the circular cam arranged outside the active cam part.

5. The folder as claimed in claim 1 wherein the cam element carrier and the associated adjustment disk adapted to be driven evenly therewith are drivingly connected with each other by means of a differential drive which is able to be adjusted by means of an auxiliary drive device, which is able to be inactivated during a production run.

6. The folder as claimed in claim 1 wherein the tucking blades and the cam elements associated with the holding elements are connected with each other in a manner preventing relative rotation and clamped together in a releasable manner.

7. The folder as claimed in claim 6 wherein the cams associated with the tucking blades and, respectively, holding elements are spaced from each other in the axial direction and receive covering means arranged between the two cam element carriers facing each other.

8. The folder as claimed in claim 1 wherein the cam associated with the holding elements is able to be adjusted in the peripheral direction by an auxiliary drive which is ablle to be inactivated during production.

9. The folder as claimed in claim 1 comprising a 7-part collect cylinder for a web feed gravure press with up to eight etchings on the periphery of the gravure cylinder eight covering cam elements being provided on the periphery of the cam element carrier.

10. The folder as claimed in claim 9 wherein two covering cam element groups offset by 180° of four elements each are provided and between the peripheral outline center points of the first and the second peripheral cam element there is a spacing of 30°, of the second and third peripheral cam element there is a spacing of 15° and of the third and fourth peripheral cam elements there is a spacing of 45°.

11. The folder as claimed in claim 1 wherein the peripheral length of the covering cam elements subtends an angle of approximately 15°.

12. The folder as claimed in claim 10 wherein each adjustment disk has six peripheral cam elements separated from each other by a respective peripheral recess and is able to be moved into four peripheral positions with different positions corresponding to the following types of production: single collection and non-collection.

13. The folder as claimed in claim 12 wherein each adjustment disk has two cam element groups, offset by 180°, each of three peripheral cam elements of different lengths, and the first peripheral cam element has a peripheral length of approximately 13.5°, the second of approximately 1° and the third of approximately 24.5° and between the first and the second peripheral cam elements there is a center distance of approximately 48.25° and between the second and third ones a distance of approximately 57.25°.

14. The folder as claimed in claim 1 wherein the drive of each cam element carrier and of each adjustment disk is able to be inactivated.

15. The folder as claimed in claim 1 wherein each cam element carrier and the adjustment disks able to be driven evenly therewith are adapted to be driven in a way dependent on the desired type of production at two different speeds.

16. The folder as claimed in claim 15 wherein the drive speed of the cam element carriers and of the adjustment disks in the case of collect production with an even number of consecutive collect operations is equal to 7/6 of the speed of the collect cylinder and in the case of an uneven number of consecutive collect operations is equal to $\frac{7}{8}$ of the speed of the collect cylinder.

17. The folder as claimed in claim 14 wherein a clutch with two defined positions of engagement and a non-engaged position is provided in a mechanical driving train for the cam element carriers.

18. The folder as claimed in claim 17 wherein the said driving train has an intermediate shaft parallel to the axis of the cylinder and said intermediate shaft is adapted to drive the cam element carriers and the adjustment disks via an intermediate adjustable differential drive and which is able to be coupled by means of a coupling part arranged on it in a sliding manner with one of a number of oppositely placed drive wheels freely rotatable thereon and having different diameters, such drive wheels meshing with different gear rings of a double wheel driven by a part of the cylinder.

19. The folder as claimed in claim 18 wherein the differential drive is arranged radially outside the intermediate shaft and has input and output wheels with the same diameter, of which the input wheel meshes with pinion keyed on the intermediate shaft, and the pinion is simultaneously in mesh with an intermediate wheel associated with one of the cam element carriers, said intermediate wheel being arranged adjacent to an intermediate wheel associated with the adjustment disks of the same diameter, and which meshes with one gear ring of double wheel having two gear rings with the same diameter as the pinion and mounted in a freely rotatable manner adjacent to the pinion on the intermediate shaft, and the other gear ring thereof meshes with the output wheel of the differential drive.

20. The folder as claimed in claim 18 wherein in the case of a double-breadth collect cylinder with gripper rails and tucking blades subdivided along the length of the cylinder and respectively one operating device arranged adjacent to the two cylinder end sides and with covering devices associated with the latter with driven cam element carriers and adjustment disks able to be driven evenly with the latter the intermediate shafts respectively provided in the drive train, of which one is able to be coupled via a clutch with the cylinder drive device are arranged radially outside the cylinder periphery and are able to be coupled via an intermediate shaft extending along the length of the cylinder.

* * * * *